US006851681B2

(12) United States Patent
Svensson et al.

(10) Patent No.: US 6,851,681 B2
(45) Date of Patent: Feb. 8, 2005

(54) SKATE FRAME WITH CAP CONSTRUCTION

(75) Inventors: John E. Svensson, Vashon, WA (US); Dodd H. Grande, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 10/421,003

(22) Filed: Apr. 21, 2003

(65) Prior Publication Data

US 2003/0193150 A1 Oct. 16, 2003

Related U.S. Application Data

(63) Continuation of application No. 09/861,170, filed on May 18, 2001, now abandoned, which is a continuation-in-part of application No. 09/199,398, filed on Nov. 24, 1998, now Pat. No. 6,422,577.

(51) Int. Cl.[7] ..... A63C 17/04

(52) U.S. Cl. ..... 280/11.221; 280/11.231

(58) Field of Search ..... 280/11.221, 11.223, 280/11.28, 11.27, 11.225, 11.3, 11.26, 7.13, 11.19, 11.227, 11.231, 11.222, 825, 602, 11.233, 11.24, 11.25

(56) References Cited

U.S. PATENT DOCUMENTS

| | | | |
|---|---|---|---|
| 109,026 | A | 11/1870 | Leak |
| 110,858 | A | 1/1871 | Kimball |
| 2,644,692 | A | 7/1953 | Kahlert |
| 3,637,231 | A | 1/1972 | Weidenbacker |
| 3,901,521 | A | 8/1975 | Famolare, Jr. |
| 4,273,345 | A | 6/1981 | Ben-Dor et al. |
| 4,909,523 | A | 3/1990 | Olson |
| 4,932,675 | A | 6/1990 | Olson et al. |
| 5,046,746 | A | 9/1991 | Gierveld |
| 5,092,614 | A | 3/1992 | Malewicz |
| 5,340,132 | A | 8/1994 | Malewicz |
| 5,346,231 | A | 9/1994 | Ho |
| 5,380,020 | A | 1/1995 | Arney et al. |
| 5,385,356 | A | 1/1995 | Conte |
| 5,388,846 | A | 2/1995 | Gierveld |
| 5,397,141 | A | 3/1995 | Hoshizaki et al. |
| 5,462,295 | A | 10/1995 | Seltzer |
| 5,513,861 | A | 5/1996 | Monroy et al. |
| 5,533,740 | A | 7/1996 | Lin |
| 5,549,309 | A | 8/1996 | Gleichmann |
| 5,560,625 | A | 10/1996 | Kuykendall |
| 5,586,777 | A | 12/1996 | Wolf |
| 5,599,036 | A | 2/1997 | Abondance et al. |
| 5,630,624 | A | 5/1997 | Goodman |
| 5,720,488 | A | 2/1998 | Foffano et al. |
| 5,732,958 | A | 3/1998 | Liu |
| 5,806,860 | A | 9/1998 | Conte |
| 5,876,044 | A | 3/1999 | Yin |
| 5,918,889 | A | 7/1999 | Tai |
| 5,934,692 | A | 8/1999 | Artus |
| 5,934,693 | A | 8/1999 | Nicoletti |
| 6,095,547 | A | 8/2000 | Vandergrift et al. |
| 6,189,898 | B1 | 2/2001 | Benoit |

FOREIGN PATENT DOCUMENTS

| | | |
|---|---|---|
| EP | 0 321 026 | 6/1989 |
| WO | WO 98/02217 | 1/1998 |

*Primary Examiner*—Hau Phan
(74) *Attorney, Agent, or Firm*—Christensen O'Connor Johnson Kindness PLLC

(57) ABSTRACT

A skate frame (20) for an in-line skate (18) having a shoe portion (22) and a plurality of wheels (24) capable of traversing a surface. The skate frame includes an elongate structural member comprised of a structural material having a first average density. The structural member having first and second sidewalls (62, 68). The structural member also includes a shoe mounting portion (50) spanning between at least a portion of the upper ends of the sidewalls. The skate frame also includes core material (64) disposed within at least one of the first and second sidewalls or within the shoe mounting portion. In an embodiment of the invention a threaded insert (602) is embedded in the core material of one sidewall, and an aligned tubular insert is installed in the opposite sidewall, such that the wheel axle (612) can be inserted through the tubular insert to engage the embedded threaded insert. In another embodiment, a protective cap (770) protects and/or enhances the appearance of the skate frame.

19 Claims, 10 Drawing Sheets

Fig. 7.
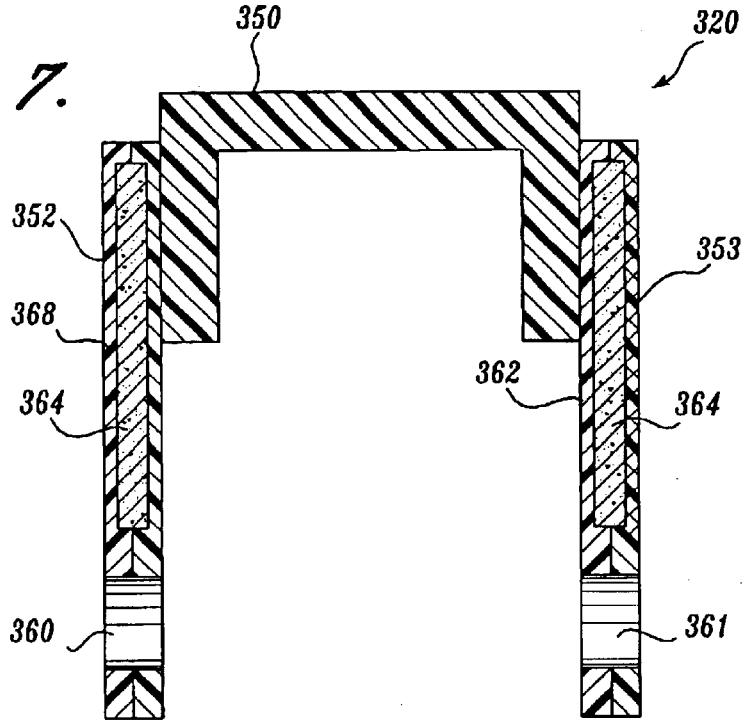
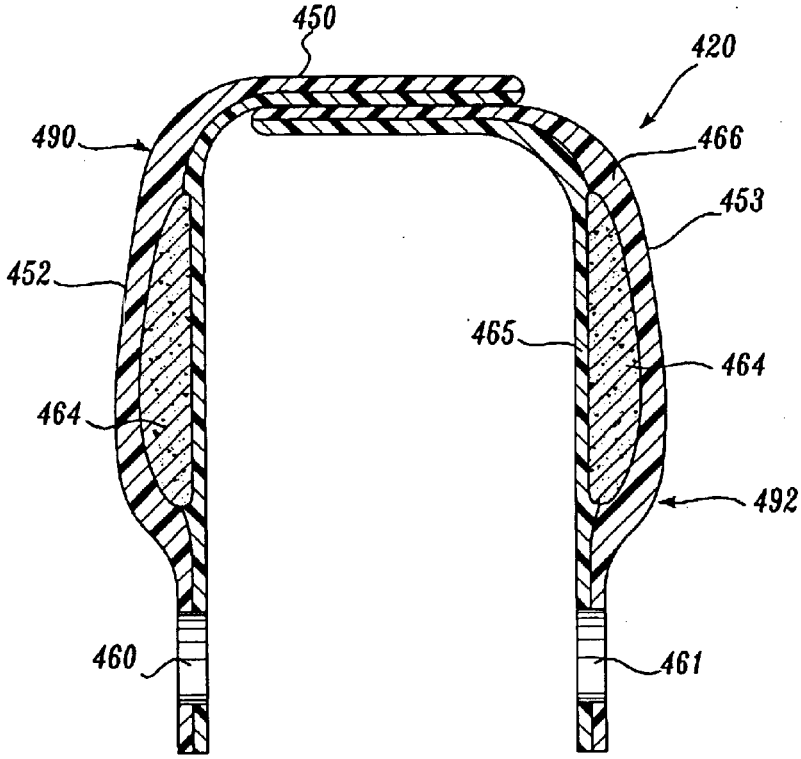
Fig. 8.

SKATE FRAME WITH CAP CONSTRUCTION

CROSS-REFERENCES TO RELATED APPLICATIONS

This application is a continuation of application Ser. No. 09/861,170, filed May 18, 2001, now abandoned, which is a continuation-in-part of application Ser. No. 09/199,398, filed Nov. 24, 1998, now U.S. Pat. No. 6,422,577, priority from the filing date of which is hereby claimed under 35 U.S.C. §120.

FIELD OF THE INVENTION

The present invention relates generally to skates and, in particular, to a skate frame having a core of lightweight material to increase structural strength-to-weight and stiffness-to-weight ratio of the frame.

BACKGROUND OF THE INVENTION

In-line roller skates generally include an upper shoe portion having a base secured to a frame that carries a plurality of longitudinally aligned wheels. The upper shoe portion provides the support for the skater's foot, while the frame attaches the wheels to the upper shoe portion. Because in-line skates are designed to accommodate a variety of skating styles, including high-performance competitions, it is desirable for such skate frames to be lightweight, stiff, and strong. Skate frames may be constructed from a variety of materials, including aluminum, injection molded plastic, and composites. Although aluminum skate frames are structurally strong and stiff, they are expensive. Skate frames constructed from an injection-molded plastic are often reinforced with short, discontinuous fibers. Although such skate frames are lower in cost than aluminum frames, they lack the specific strength and stiffness performance characteristics associated with continuous fiber-reinforced composite frames.

Currently, fibers of glass or carbon are preferred to reinforce composite frames. Glass reinforced composite skate frames are both structurally stiff and strong, but they are heavier than composite frames reinforced with carbon fibers. Although carbon fiber reinforced skate frames are lightweight, strong, and stiff, they are expensive.

Frames constructed from composites reinforced with glass, carbon fibers, or other high performance fibers, may be improved by sandwiching a core material between face sheets or skins of reinforced composite material. The core is a lighter, less expensive material with moderate structural properties in terms of strength and stiffness.

Prior in-line skate frames having a core construction include inverted U-shaped skate frames having a polymer core bonded within the concave portion of the skate frame. In such skate frames, the core is positioned between the frame's arcuate portion and the wheels. Although such skate frames provide increased structural stiffness, the core is subjected to accelerated wear and damage because it is exposed directly to the wheels and road debris. Therefore, such a skate frame may have a shortened useful life.

Other attempts of providing an in-line skate frame with a core include inverted U-shaped skate frames with core material sandwiched between two composite face sheets. In this type of frame, the core extends from below the wheel attachment points upwardly and across the upper surface of the frame. The wheels and shoe portion of the skate are attached to the frame by drilling or molding their respective attachment points through the sandwich construction, thereby subjecting the core material directly to the loads of both the wheel axle and shoe portion attachment bolts. This construction is undesirable because the core material is in direct contact with the wheel and shoe attachment hardware and, therefore, is susceptible to breakage.

Still other attempts of providing in-line skate frames with a core have included a core inserted within the junction between the sole of the shoe portion and the skate frame. Such skate frames have a flange extending laterally from both sides of the upper end of the skate frame, such that the lateral and medial sides of the upper surface span outwardly to cup the sole of the shoe portion therein. The interior of the flange portion is filled with a core material to absorb a portion of the loads associated with traversing a surface. The location of the flanges relative to the frame is custom made to accommodate a particular skater's foot and shoe width. Because the flange portion is sized to cup a specific shoe width, there is limited adjustment of the location of the shoe portion relative to the frame. Therefore, such a skate frame is not very robust in accommodating different skating styles, even for the skater for whom the skate was custom made. Moreover, because the skate is custom made and designed for a particular skater, it is expensive to manufacture.

Thus, there exists a need for a composite in-line skate frame having a lightweight core that not only maintains the frame's strength and stiffness, but also is economical to manufacture, and meets the performance expectations of a skater.

SUMMARY OF THE INVENTION

The present invention provides both a skate frame for an in-line skate having an increased structural strength-to-weight ratio, and a method of constructing such a frame. The in-line skate has a shoe portion and a plurality of longitudinally aligned wheels capable of traversing a surface. The skate frame includes first and second sidewalls and a shoe-mounting portion. Preferably, the sidewalls and shoe-mounting portion include skins constructed from a material having a first average density. Each of the sidewalls has an upper end and a lower end. The lower ends of the sidewalls include wheel load introduction portions, wherein loads associated with the wheels are transferred to the sidewalls. The upper ends of the sidewalls are held in spaced parallel disposition by the shoe-mounting portion spanning therebetween. The shoe-mounting portion includes a shoe load introduction portion, wherein loads associated with the shoe portion are transferred to the shoe-mounting portion. The skate frame also includes core material disposed within at least the first and second sidewalls, or within the shoe-mounting portion. The core material is removed from at least the wheel and shoe load introduction portions.

In an aspect of a skate frame constructed in accordance with the present invention, the core material has a second average density that is less than the material density of the skins of both the sidewalls and shoe-mounting portion by a predetermined amount and has predetermined structural properties. The core material occupies a volume within the skate frame to provide the skate frame with an increased structural strength-to-weight ratio.

In an aspect of the first preferred embodiment of the present invention, the core material is positioned within sidewalls. The core material is chosen from a group of materials that includes both reinforced and unreinforced polymers and natural materials.

In another aspect of the first preferred embodiment of the present invention, the skate frame also includes a plug of filler material disposed between the core material and the load introduction portions to absorb at least a portion of the loads associated with the wheels and shoe portion.

In yet another aspect of the present invention, the core material defines a varying height along a longitudinal axis extending between the ends of the skate frame.

In an alternate embodiment of the present invention, core material is disposed within the shoe mounting portion.

In yet another alternate embodiment of the present invention, core material is disposed within both the first and second sidewalls and the shoe-mounting portion.

A method of constructing a skate frame for an in-line skate is also provided. The method includes the steps of forming a U-shaped first skin and positioning core material at a predetermined location on the first skin. The method further includes the step of forming a U-shaped second skin over the first skin, such that the core material is positioned and sealed between the first and second skins. A plug of filler material is disposed between the first and second skins to absorb at least a portion of the loads associated with at least the wheels or shoe portion of the skate. Finally, the method includes the step of curing the frame.

The skate frame of the present invention provides several advantages over skate frames currently available in the art. The skate frame of the present invention is lighter than solid composite or aluminum frames because a lightweight core material occupies a substantial volume within the frame. Also, because the core material is lightweight and provides a distance of separation between the skins of the sidewall, the strength-to-weight ratio of the frame is increased. Further, because the skate frame utilizes a core material that is less expensive than the reinforced composite material it replaces, it is more cost efficient than skate frames having an all-composite construction. Finally, because the core material is removed from the load introduction points associated with the wheels and shoe portion, the skate frame has a longer useful life than skate frames having a core that is in direct contact with the load introduction points. Thus, a skate frame constructed in accordance with the present invention has an increased strength-to-weight ratio and is less expensive than those currently available in the art.

In another embodiment, for each wheel a threaded insert is embedded in the core material in the lateral sidewall with the threaded portion extending into the channel between the first and second sidewall. A tubular insert is installed in the medial sidewall, in axial alignment with the threaded insert, such that a threaded axle can be inserted through the threaded insert and the wheel, to engage the threaded insert, thereby rotatably attaching the wheel to the frame.

In another embodiment of the invention, the first and second sidewalls of the skate frame include a affixed to the outwardly facing surface of each sidewall that wraps around the peripheral edges of the sidewall.

In an embodiment of the invention a polymeric cap film sheet is placed over a frame mold, a composite layer is layed up over the film sheet, substantially filling the mold, and a mold cover is placed over the composite layer and the composite layer is cured.

In an embodiment of the invention a polymeric cap film sheet is placed over a frame mold, a first composite layer is layed up over the film sheet, a polymeric foam core is placed over the composite layer and a second composite layer is layed up over the foam core, substantially encapsulating the foam core. The composite layers are then allowed to cure.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 7 is a cross-sectional end view of a fourth alternate embodiment of an in-line skate frame constructed in accordance with the present invention showing a three-piece frame and core material disposed within the sidewalls of the frame;

FIG. 8 is a cross-sectional end view of a fifth alternate embodiment of a two-piece in-line skate frame constructed in accordance with the present invention showing core material disposed within the sidewalls of the skate frame;

DETAILED DESCRIPTION OF THE PREFERRED EMBODIMENT

Figure 1:
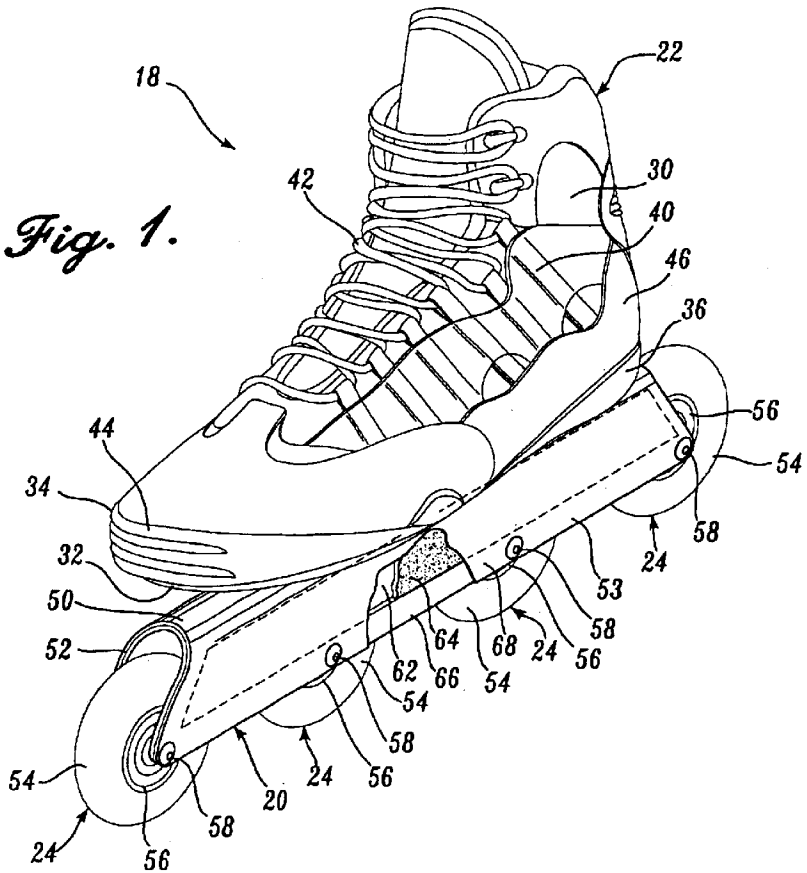
FIG. 1 is an environmental view of an in-line skate frame constructed in accordance with the present invention having a portion of the skate frame cut away to show the inner skin, core material, filler material and outer skin.

FIG. 1 illustrates a preferred embodiment of an in-line skate 18 having a skate frame 20 constructed in accordance with the present invention. The skate frame 20 is shown attached to a shoe portion 22 and a bearing member in the form of a plurality of wheels 24.

The shoe portion 22 has an upper portion 30 and a base 32. The upper shoe portion 30 is preferably constructed from a flexible and durable natural or man-made material, such as leather, nylon fabric, or canvas. The upper shoe portion 30 also includes a conventional vamp 40 and vamp closure, including a lace 42, extending along the top of the foot from the toe area of the foot to the base of the shin of the skater. Preferably, the upper shoe portion 30 is fixedly attached to the base 32 by being secured beneath a last board (not shown) by means well-known in the art, such as adhesive, riveting, or stitching. Alternatively, any skate footwear may be used with frame of present invention.

The base 32 is constructed in a manner well known in the art from a resilient composite polymeric or natural material. The base 32 includes a toe end 34, a heel end 36 and a toe cap 44. Suitable materials for the base 32 includes semi-rigid thermoplastic or thermosetting resins, which may be reinforced with structural fibers, such as carbon reinforced epoxy, or other materials, such as leather, wood, or metal. The toe cap 44 surrounds the toe end of the upper shoe portion 30 and is suitably bonded to the base 32. Alternatively, the toe cap 44 may not be used or may be formed of a different material from the rest of the base 32, such as rubber. Because the upper shoe portion 30 is preferably constructed from nylon or other flexible, natural, or man-made materials, the function of the toe cap 44 is to protect the toe end of the upper shoe portion 30 from impact, wear, and water. The toe cap 44 also extends around the lateral and medial sides of the toe end of the upper shoe portion 30 to provide additional support to the foot of the skater.

Figure 2:
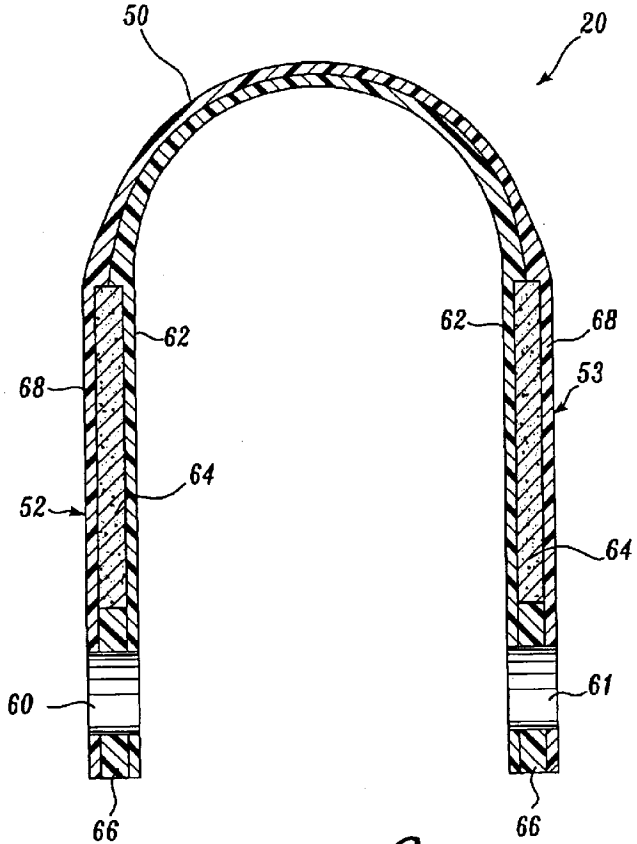
FIG. 2 is a cross-sectional end view through an in-line skate frame constructed in accordance with the present invention showing the core material disposed between the inner and outer skins of the sidewalls and a plug of filler material disposed around the wheel attachment bores.

Referring to FIGS. 1 and 2, attention is now drawn to the skate frame 20. The frame 20 is preferably configured as an inverted, substantially U-shaped elongate member. The spine of the frame 20 defines a shoe mounting portion 50 and the downwardly-depending sides thereof defined first and second sidewalls 52 and 53. The first and second sidewalls 52 and 53 are held in spaced parallel disposition by the shoe mounting portion 50, such that a plurality of longitudinally aligned wheels 24 are receivable between the lower ends of the sidewalls 52 and 53. Although the frame 20 is illustrated as a single-piece frame having sidewalls integrally formed with the shoe mounting portion, other configurations, such as two- and three-piece frames, are also within the scope of the invention and are described in greater detail below.

The wheels 24 are conventional roller skate wheels well known in the art. Each wheel 24 has an elastomeric tire 54 mounted on a hub 56. Each wheel 24 is journaled on bearings and is rotatably fastened between the first and second sidewalls 52 and 53 on an axle bolt 58. The axle bolt 58 extends between laterally aligned first and second axle mounting holes 60 and 61 (FIG. 2) located in the lower ends of the first and second sidewalls 52 and 53. The axle bolt 58 also extends laterally through two rotary bearings (not shown) located in the hub 56 of each wheel 24. Preferably, the wheels 24 are journaled to the frame 20 in a longitudinally aligned arrangement and are positioned substantially midway between the lateral and medial sides of the shoe portion 22.

The base 32 of the shoe portion 22 may be rigidly fastened to the shoe mounting portion 50 of the frame 20 by well-known fasteners (not shown), such as bolts or rivets. The fasteners extend vertically through the toe and heel ends 34 and 36 of the base 32 and into corresponding holes extending vertically through the shoe mounting portion 50. Although it is preferred that the shoe portion 22 be rigidly fastened to the frame 20, other configurations, such as detachably or hingedly attaching the shoe portion to the skate frame, are also within the scope of the present invention.

The frame 20 includes an inner skin 62, core material 64, structural filler material 66, and an outer skin 68. Within the meaning of this specification, skins are used to designate layer or layers of material. The inner and outer skins 62 and 68 are preferably constructed in a manner well known in the art from a lightweight and high strength material, such as a carbon fiber reinforced thermosetting polymer or a fiber reinforced thermoplastic. Preferably, the filler material 66 is also a lightweight and high strength material having structural properties, such as strength and stiffness, greater than the core material 64. In particular, the filler material 66 can be the same composite material used to construct the inner and outer skins 62 and 68, or the filler material 66 can be some other material that is more structural and dense than the core material 64. Thus, while the type of material used as filler material 66 is not important to the invention, it is important that the filler material 66 is more structural in terms of stiffness, density, and strength than the core material 64. Furthermore, although the preferred embodiment is illustrated and described as having a separate plug of filler material 66, other configurations, such as a frame without filler material, are also within the scope of the present invention and are described in greater detail below.

Still referring to FIGS. 1 and 2, core material 64 is disposed within the first and second sidewalls 52 and 53 by being sandwiched between the inner and outer skins 62 and 68 of both sidewalls 52 and 53. The core material 64 has an average density that is less than the skins 62 and 68 and the filler material 66. Preferably, the core material 64 is an unreinforced or reinforced polymer, such as a structural foam or a syntactic foam, or a natural material, such as wood. The core material 64 may also be a viscoelastic material. The core material 64 is substantially rectangular in configuration and is disposed within each sidewall 52 and 53, such that the length of the core material 64 is parallel to a longitudinal axis extending between the ends of the frame 20. The core material 64 is located a predetermined distance above the first and second axle mounting holes 60 and 61 of the first and second sidewalls 52 and 53. A plug of filler material 66 surrounds the axle mounting holes 60 and 61 and borders the lower end of the core material 64. As configured, the filler material 66 absorbs at least a portion of the loads associated with the axle bolt 58 (FIG. 1) received therein. Because filler material 66 surrounds the axle mounting holes 60 and 61, it eliminates direct contact between the axle bolt 58 and the core material 64, thereby minimizing the risk of damage to the core material 64 from the axle bolt 58.

Figure 3:
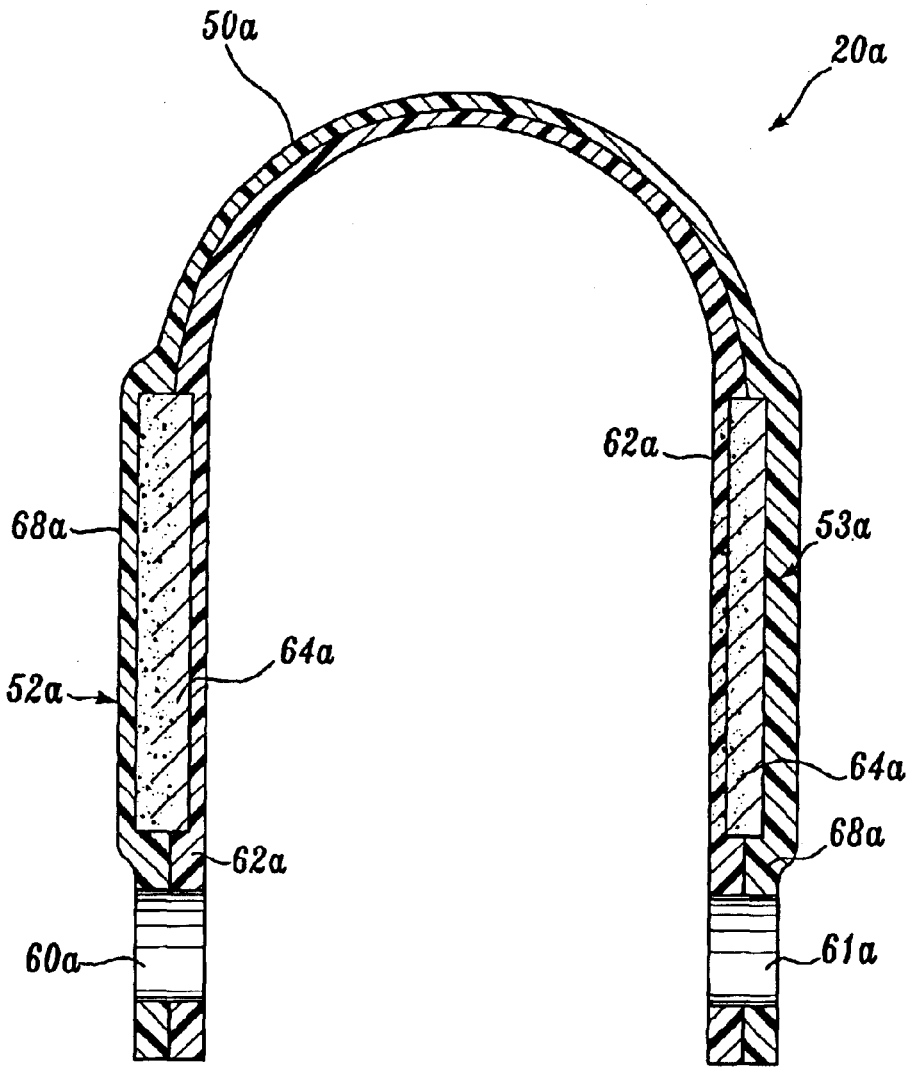
FIG. 3 is a cross-sectional end view of an alternate embodiment of an in-line skate frame constructed in accordance with the present invention showing the core material disposed between the inner and outer skins of the sidewalls.

Although it is preferred to have a plug of filler material 66 surrounding the axle mounting holes 60 and 61, other configurations are also within scope of the invention. As seen in the nonlimiting example of FIG. 3, the frame 20*a* may be constructed without filler material. The frame 20*a* is constructed in the same manner as described above for the preferred embodiment, with the exception that core material 64*a* is sealed within the first and second sidewalls 52 and 53 by the inner and outer skins 62*a* and 68*a*. The inner and outer skins 62*a* and 68*a* seal the core material 64*a* within the frame 20*a*, such that the skins 62*a* and 68*a* border all of the edges of the core material 64*a*. As configured, the skins 62*a* and 68*a* combine to surround the axle mounting holes 60*a* and 61*a*. Thus, although filler material is preferred, it is not necessary for the present invention.

As may be seen better by referring back to the preferred embodiment of FIG. 1, core material 64 extends nearly the length of the frame 20. The longitudinal ends of the core material 64 are sealed by the inner and outer skins 62 and 68, thereby avoiding structural failure or degradation of the core material 64 due to concentrated loads, abrasion, and/or impact. Furthermore, as seen in FIG. 2, to limit damage to the core material 64 due to concentrated loads associated with the attachment of the shoe portion 22 to the frame 20, there is no core material 64 disposed within the shoe mounting portion 50. Thus, when the shoe portion 22 is attached to the shoe mounting portion 50 in the manner described above, there is no direct contact loading between the fasteners (not shown) attaching the shoe portion 22 to the frame 20 and the core material 64.

As configured, the risk of damage to the core material 64 from the shoe portion 22, the wheels 24 and direct exposure to the environment is minimized by utilizing an enclosed torsion box construction, wherein the core material 64 is sealed within the frame 20. Damage to the core material 64 is also minimized by removing core material from at least the load introduction portions of the frame 20, wherein loads associated with the wheels 24 and shoe portion 22 are transferred to the frame 20. Furthermore, because the core material 64 has a density that is less than that of either the filler material 66 or the material used to construct the inner and outer skins 62 and 68, and because it occupies a substantial volume within the sidewalls 52 and 53, the frame 20 is lighter than a comparable frame without the core.

Figure 4:
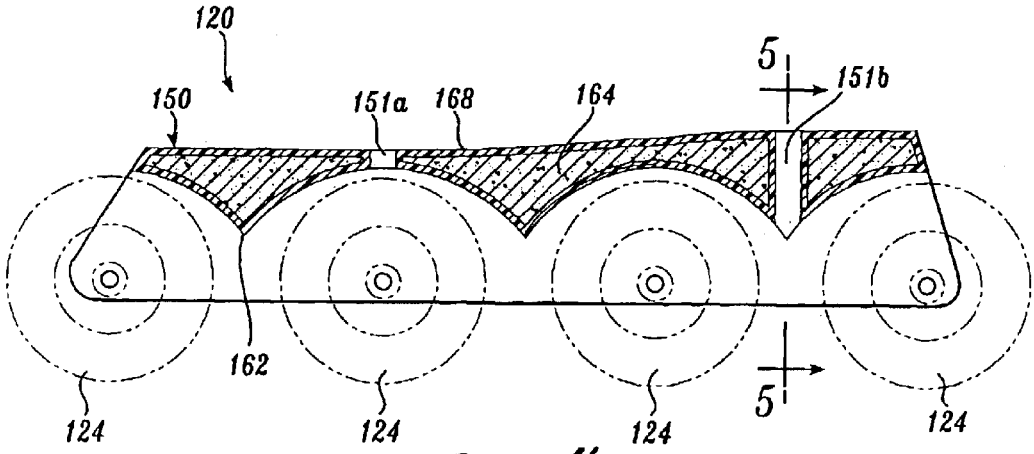
FIG. 4 is a cross-sectional side view through a second alternate embodiment of an in-line skate frame constructed in accordance with the present invention showing core material disposed within the shoe mounting portion of the skate frame.
Figure 5:
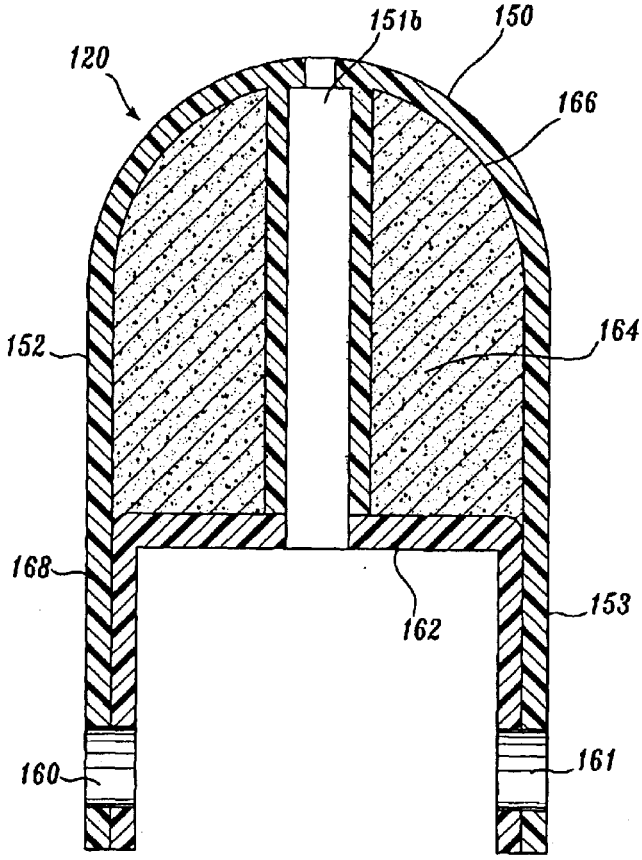
FIG. 5 is a cross-sectional end view of the second alternate embodiment of an in-line skate frame constructed in accordance with the present invention taken through Section 5—5 of FIG. 4 showing core material disposed within the shoe mounting portion of the skate frame.

Although it is preferred to dispose core material 64 within the first and second sidewalls 52 and 53 of a U-shaped frame, other locations of the core material 64 are also within the scope of the present invention. As seen in the first alternate embodiment of FIGS. 4 and 5, core material 164 may be located within the shoe mounting portion 150 of the frame 120. In this alternate embodiment, the frame 120 is constructed as described above for the preferred embodiment, except that core material 164 is now positioned between the inner and outer skins 162 and 168 of the shoe mounting portion 150 instead of being disposed within the sidewalls 152 and 153. As may be seen better in FIG. 5, core material 164 extends between the sidewalls 152 and 153, and is positioned above the wheels. Referring back to FIG. 4, the core material 164 contours the tops of the wheels 124 (shown in phantom), such that the core material 164, bounded along its lower edge by the skin 162, defines C-shaped wheel wells around the upper surface of each wheel 124.

As configured within the shoe mounting portion 150 of the skate frame 120, the core material 164 has a variable depth along the longitudinal direction of the skate frame 120. As seen better in FIG. 5, the core material 164 is not only positioned between the skins 162 and 168 of the shoe mounting portion 150, but the core material 164 also extends between the first and second sidewalls 152 and 153 of the frame 120.

Preferably, the upper shoe mounting portion 150 also includes a pair of vertically extending shoe attachment bores 151*a* and 151*b*. The shoe attachment bores 151*a* and 151*b* are each sized to receive a shoe attachment fastener (not shown) vertically therethrough. The fasteners are adapted to attach the toe and heel ends of the shoe portion 22 (FIG. 1) to the frame 120. Preferably, the edges of the core material 164 adjacent the attachment bores 151*a* and 151*b* are sealed within the shoe mounting portion 150 by the skins 162 and 168 to eliminate direct contact between the core material 164 and the shoe attachment fasteners. Thus, the core material 164 is sealed within the shoe mounting portion 150 by the skins 162 and 168.

Figure 6:
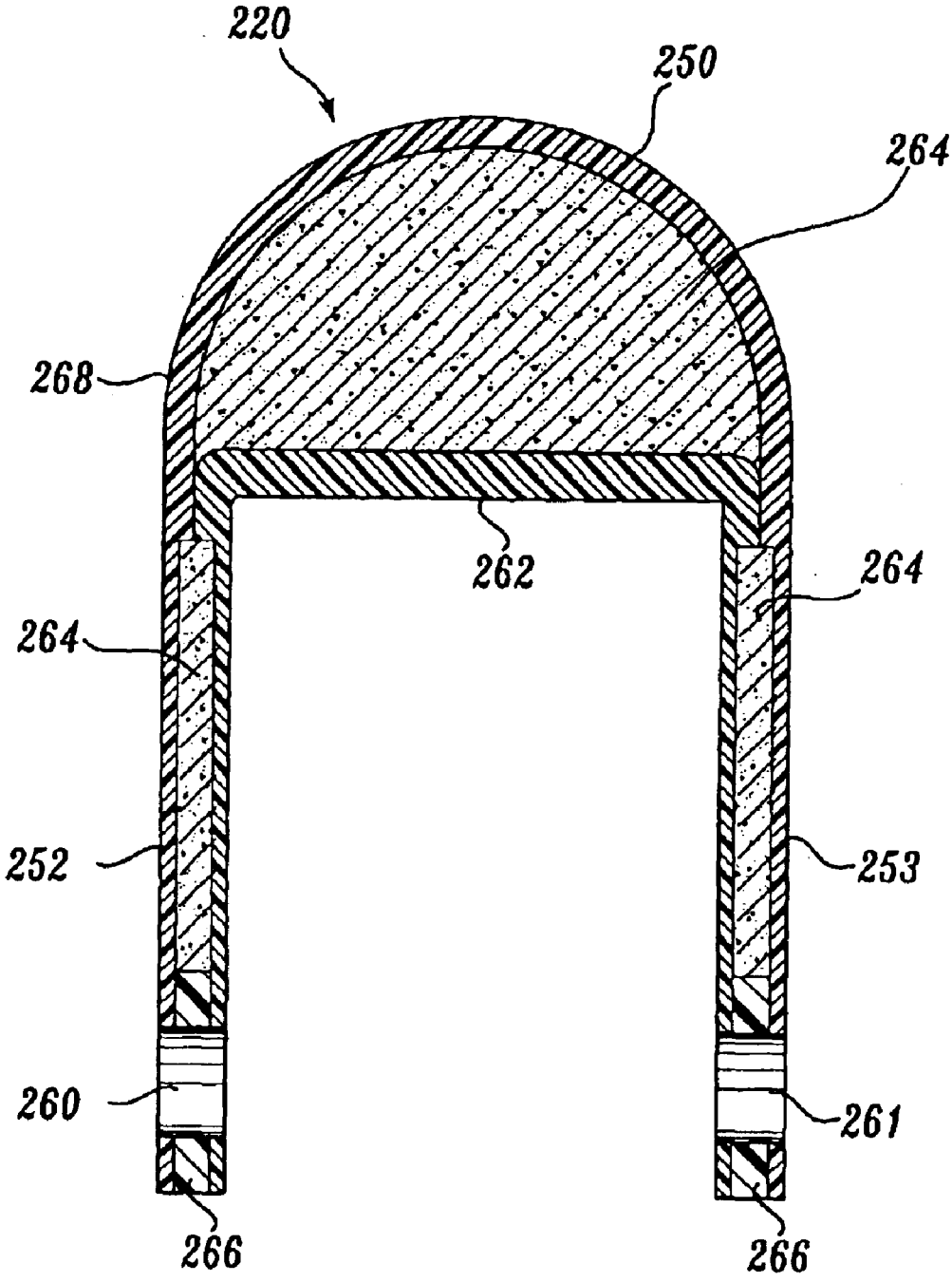
FIG. 6 is a cross-sectional end view of a third alternate embodiment of an in-line skate frame constructed in accordance with the present invention showing core material disposed between the inner and outer skins of both the sidewalls and shoe mounting portion of the skate frame.

As seen in the second alternate embodiment of FIG. 6, core material 264 may be located within multiple locations of the frame 220. In this alternate embodiment, the frame 220 is constructed as described above for the preferred embodiment and first alternate embodiment, except that core material 264 is now disposed between the skins 262 and 268 of both the shoe mounting portion 250 and the first and second sidewalls 252 and 253. The axle mounting holes 260 and 261 of this embodiment are surrounded by a plug of filler material 266 to eliminate direct contact between the core material 264 and the wheel axles (not shown). Thus, in this second alternate embodiment of the invention, core material 264 is located within both the shoe mounting portion 250 and the sidewalls 252 and 253, and is sealed therein by the skins 262 and 268 and/or the filler material 266.

Although a single piece frame having first and second sidewalls integrally formed with the shoe mounting portion is the preferred embodiment of the present invention, other configurations are also within the scope of the present invention. As seen in a first nonlimiting example of FIG. 7, the frame 320 may be a three-piece frame. The frame 320 is constructed the same as the preferred embodiment, except that the shoe mounting portion 350 and the first and second sidewalls 352 and 353 are all separate components of the frame 320. The sidewalls 352 and 353, having core material 364 sealed therein by the skins 362 and 368, are fastened to the shoe mounting portion 350 by screws, adhesive or in another manner well-known in the art. Preferably, the shoe mounting portion 350 is constructed from an aluminum or plastic material.

Figure 9:
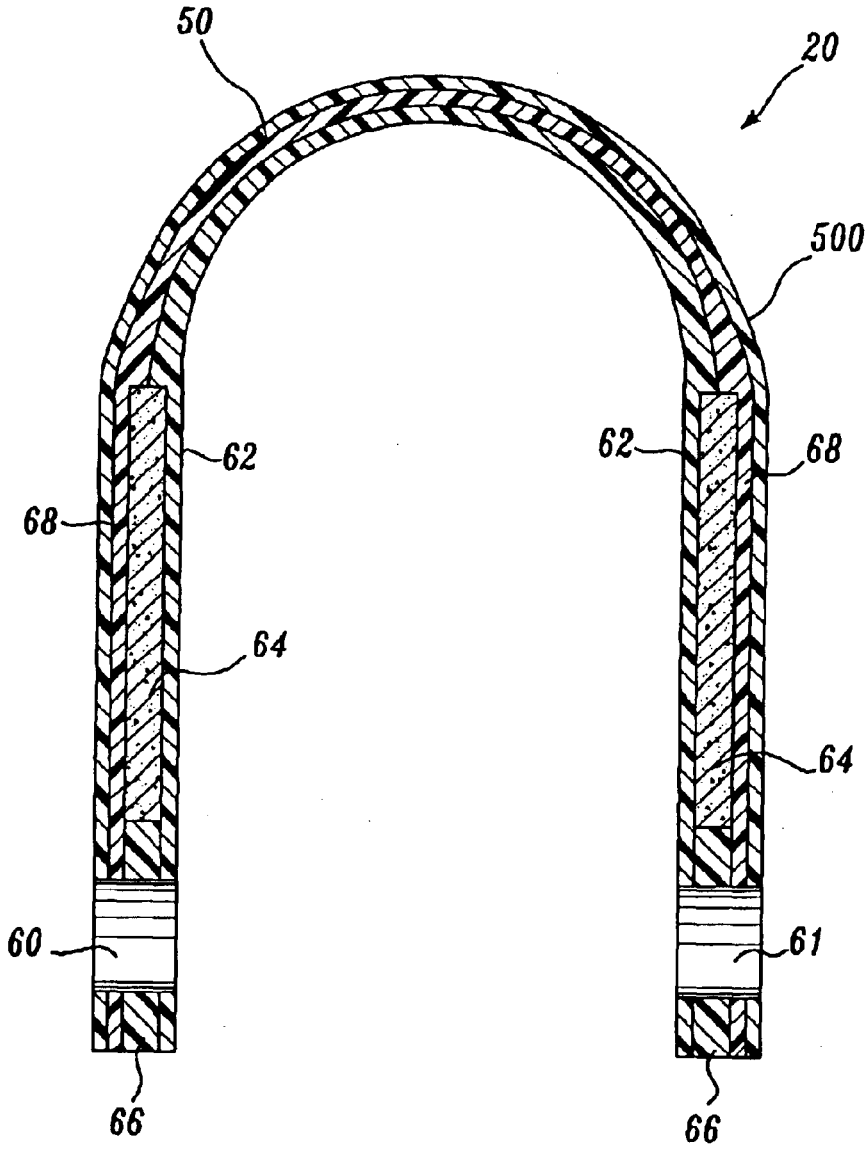
FIG. 9 is a cross-sectional end view through an in-line skate frame constructed in accordance with the present invention showing the core material disposed between the inner and outer skins of the sidewalls, a plug of filter material disposed around the wheel attachment bores, and a decorative sheet disposed on the outer skin.

As a second nonlimiting example, the frame 420 may be a two-piece frame. Referring to FIG. 8, each piece 490 and 492 of the frame 420 is configured as an inverted "L" and is preferably constructed from the same material as described above for the other example. The downwardly depending spine of each piece 490 and 492 defines the sidewalls 452 and 453. Core material 464 is sealed within each sidewall 452 and 453 in a manner described above for the preferred embodiment. Preferably, the core has a thickness contour, such that the external surface of the skate frame has a contour that reflects the contour of the core. Alternatively, and as seen in FIG. 9, each sidewall 452 and 453 has an inner and outer half 465 and 466. Each half may be stamped from a rigid material, such as aluminum, to define a contoured section. The contoured section is sized to receive the core material 464 therein, such that when the two halves 465 and 466 are joined together in a manner well known in the art, the core material 464 is disposed within the contoured sections of the inner and outer halves 465 and 466 of each sidewall 452 and 453. The base portions of each piece 490 and 492 project orthogonally from the sidewalls 452 and 453, and are adapted to be fastened together in a manner well known in the art. As fastened, the base portions combine to define the shoe mounting portion 450.

In a preferred method of constructing a frame 20, core material 64 may be sealed within the sidewalls 52 and 53 of the frame 20. First, uncured inner skin composite material reinforced with fibers is laid up on a male mold until the desired thickness is achieved. The mold is substantially U-shaped in configuration. Then, core material 64 is disposed within the mold in the desired location. In the preferred embodiment, core material is disposed along the sides of the sidewalls of the inner skin. Although it is preferred that core material is positioned along the arms of the inner skin, core material may be disposed along other portions of the inner skin, such as along the arcuate portion or along both the arcuate portion and the arms of the inner skin.

Filler material 66 is then placed in the desired location within the mold. Uncured outer skin composite material is then applied to the mold, such that the core material and filler material are sandwiched between the inner and outer skins. A female mold is placed over the lay-up and the entire lay-up is permitted to cure. Although a plug of filler material is preferred, other configurations, such as eliminating the plug of filler material and laying the inner and outer skins to seal the core material therein, are also within the scope of the method of the present invention.

An alternate method of constructing a frame 20 in accordance with the present invention is identical to the preferred method, as described above, with the following exceptions. In place of the outer skin composite material, a decorative sheet 500 may be applied to the mold, such that the core material and the filler material are sandwiched between the inner skin and the decorative sheet 500. In still yet another alternate method of constructing a frame in accordance with the present invention includes the steps as outlined above for the preferred method with the following exception. As seen in FIG. 9, after the outer skin composite material is applied to the mold, the decorative sheet 500 is applied to the outer skin, such that the core material and filler material are sandwiched between the inner and outer skins, with a decorative sheet 500 disposed on the outer skin.

Figure 10:
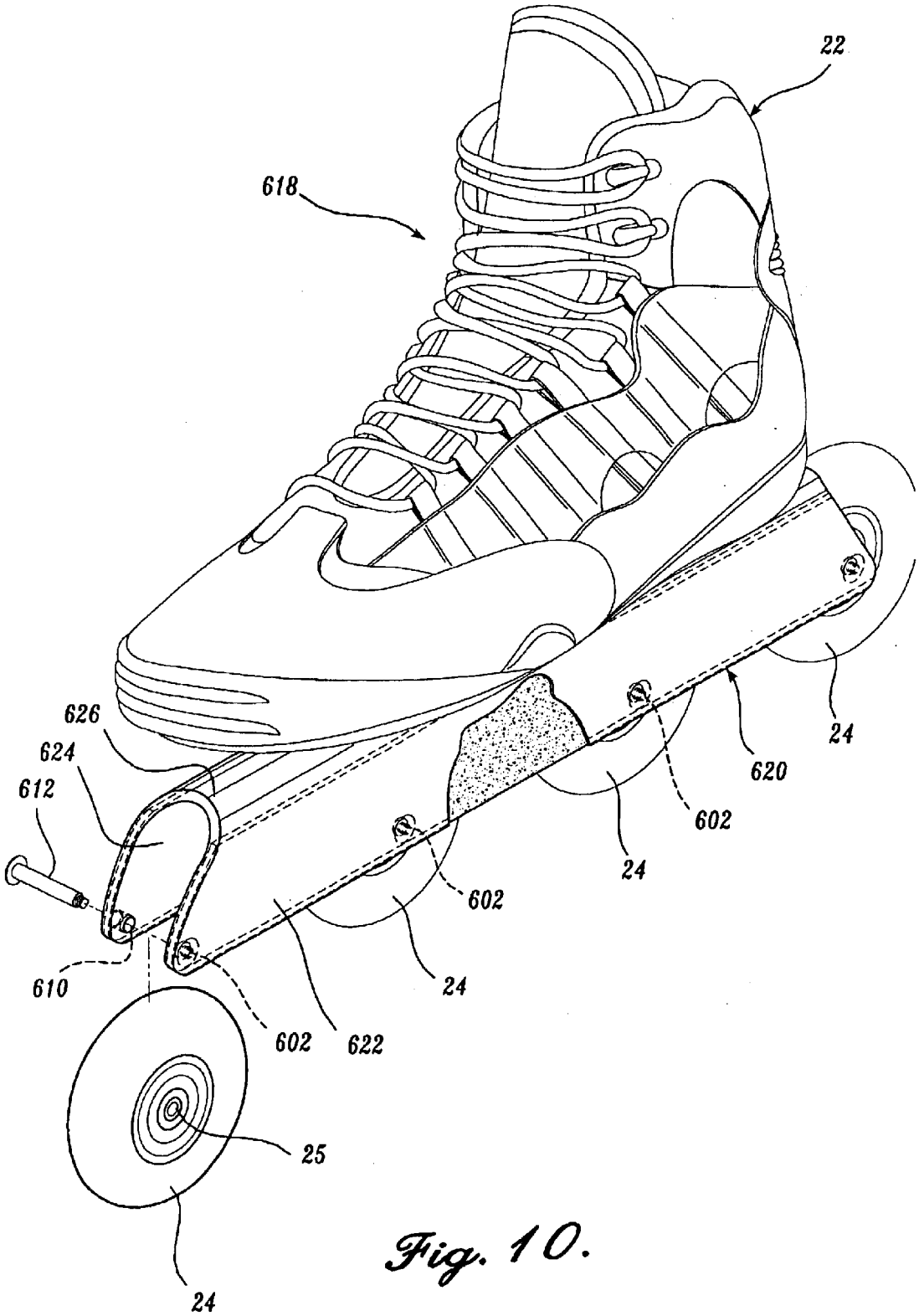
FIG. 10 is a perspective, partially cutaway and exploded view of another embodiment of a skate according to the present invention utilizing embedded threaded inserts for attachment of the wheel axles.

Another embodiment of the present invention is shown in FIG. 10, depicting a partially-exploded and cutaway view of an in-line skate 618. The in-line skate 618 includes a shoe portion 22 attached to a foam core frame 620. In this embodiment, the frame 620 includes a lateral sidewall 622 and a medial sidewall 624, each sidewall having a foam core 664 that extends to near the lower edges of both the lateral sidewall 622 and the medial sidewall 624. The foam core 664 is sandwiched between the inner and outer layers 662, 668, which may be composite structural layers, and which extend below the foam core 664 to wrap the bottom edge thereof, and extend above the foam core 664 in the transverse member 626. The transverse member 626 connects the sidewalls to form a channel therebetween that is slightly wider than the wheels 24. The transverse member 626 may be integral with sidewalls 622 and 624, as shown in FIG. 10, or formed as a separate piece fixedly attached to separate sidewalls similar to that shown in FIG. 7, or an overlapping portion of the sidewalls, similar to the construction shown in FIG. 8.

In the preferred embodiment, the transverse member 626 is formed continuously with the sidewalls, and has an arch shaped configuration. The foam core 664 extends from near the lowermost edges of the sidewalls 622, 624 to the upper end portions of the sidewalls, adjacent the beginning of the curvature of the arch shaped transverse member 626.

Figure 11:
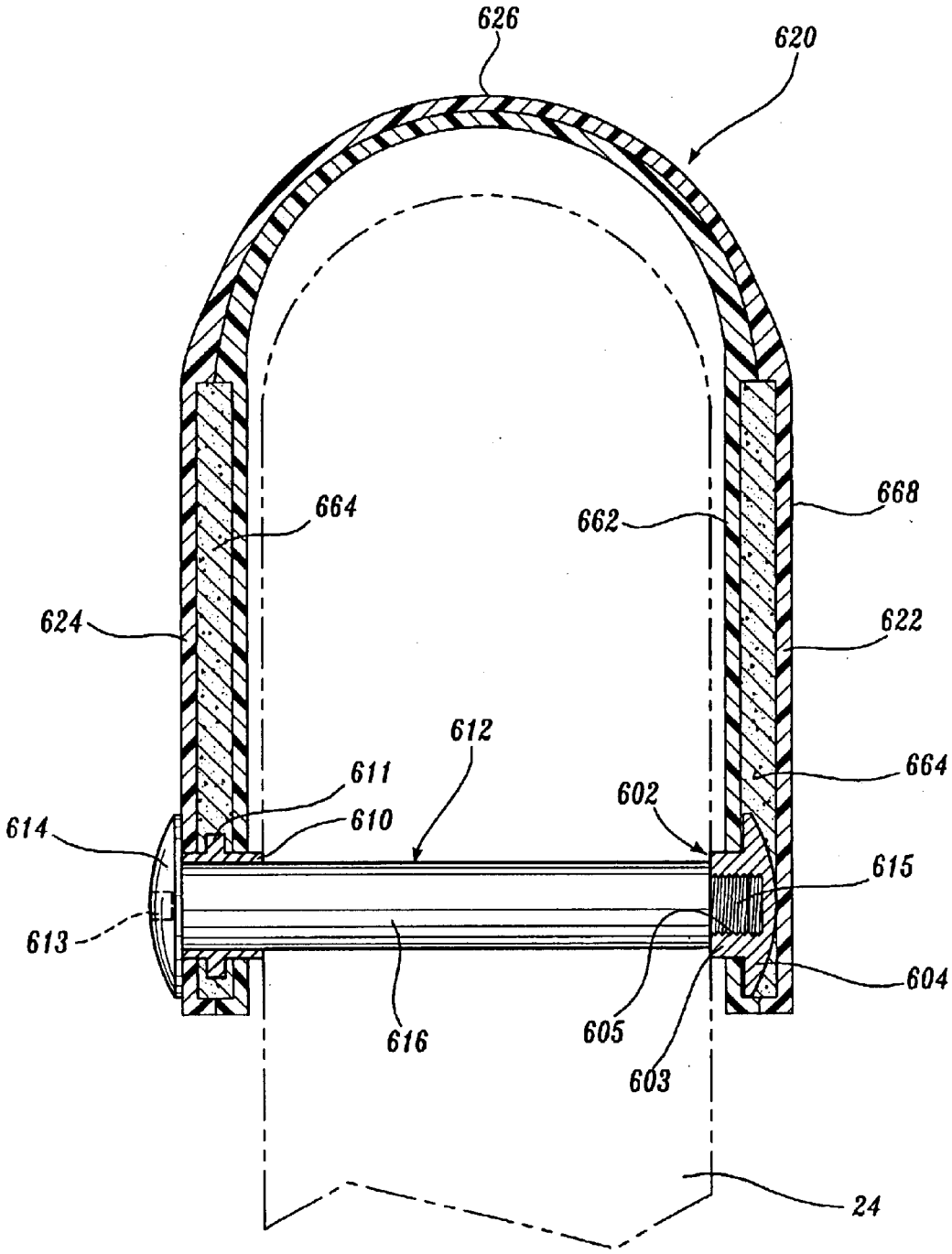
FIG. 11 is a cross-sectional view of the frame shown in FIG. 10, taken generally through an axle axis.

Referring still to FIGS. 10 and 11, threaded inserts 602 are provided in the lateral sidewall 622 for each wheel 24, spaced near the lower edge of the lateral sidewall 622. A corresponding tubular insert 610 is provided in the medial sidewall 624, each tubular insert 610 in axial alignment with a corresponding threaded insert 602. As shown most clearly in FIG. 10, an axle 612 is inserted through the medial sidewall 624 via the tubular insert 610 and through the axial aperture 25 in the wheel 24, and then engages the threaded insert 602, to rotatably attach the wheel 24 to the frame 620.

FIG. 11 shows a cross-sectional view of the frame 620 at a location generally along the axes of a threaded insert 602 and tubular insert 610 pair. FIG. 11 shows an axle 612 installed in the frame 620 with the wheel 24 shown partially in phantom. The threaded insert 602 includes a larger diameter head 604 that is embedded in and surrounded by the foam core 664 of the lateral sidewall 622, and a smaller diameter tubular portion 603 that extends through the inner layer 662 of the lateral sidewall 622 into the channel formed between the sidewalls 622, 624. The tubular portion 603 has an axial threaded aperture 605. It will be appreciated that the threaded insert 602 does not penetrate the outer layer 668 of the lateral sidewall 622, which permits a more aesthetically pleasing frame design, uninterrupted by the wheel axle hardware. The outer layer 668 of the sidewall 622 thus covers the insert 602. Also, the head 604 suitably has a non-circular, keyed perimeter whereby the foam core 664 will more securely resist rotation of the threaded insert 602. For example, a flat section (not shown) may be formed on one side of the head 604, or the head 604 may have a hexagonal configuration.

The tubular insert 610 extends all the way through the medial sidewall 624, in axial alignment with the threaded insert 602, providing an aperture therethrough having a diameter approximately equal to the diameter of the axial aperture 25 through the wheel 24. In the disclosed embodiment, the tubular insert 610 includes an outwardly-extending circumferential ridge 611, which is embedded in and surrounded by the foam core 664 of the medial sidewall 624. The circumferential ridge 611 secures the tubular insert 610 in the frame 620. It will be apparent to one of skill in the art that the present invention could be practiced without the circumferential ridge 611, by securing the tubular insert by any other suitable means, for example with a friction fit, an epoxy, or with outer flange portions. The axle 612 includes a head portion 614, including a keyed engagement aperture 613, an axle shaft 616 having a diameter slightly smaller than the aperture provided by the tubular insert 610, and a threaded end portion 615 that is adapted to engage the threaded insert 602.

The wheels 24 can therefore be easily installed in the frame 620 by aligning the axial aperture 25 of each wheel 24 between the threaded insert 602 and the tubular insert 610, inserting the axle 612 through the tubular insert 610 and the wheel aperture 25 to the threaded aperture 605, and screwing the axle 612 in place using a suitable tool keyed to the engagement aperture 613. It will be appreciated that the axle 612 can easily be installed with one hand, and that the imbedded threaded insert 602 precludes the possibility of dropped and/or lost attachment hardware that might occur in a conventional "nut and bolt" design. Moreover, it will be appreciated that in the human anatomy, the medial side of the foot is generally more easily accessible, and therefore, because the axle 612 is inserted through the medial sidewall 624, it will be relatively easy for the user to tighten and/or rotate (i.e., change the order of) the in-line wheels 24 when the in-line skates 618 are on the user's feet. It should be readily apparent to one of skill in the art, however, that the present invention could be practiced with the positions of the threaded inserts 602 and the tubular inserts 610 reversed.

As seen most clearly in FIG. 11, both the threaded insert 602 and the tubular insert 610 preferably extend slightly into the channel between sidewalls 622 and 624. This configuration holds the wheel 24 in centered alignment between the sidewalls 622, 624. Alternatively, other methods for aligning the wheels 24 may be utilized, as are well known in the art, including for example separate spacing washers.

In a preferred method of construction, the inserts 602 and 610 are placed and held in a desired position in a mold, and a foam core material such as a polymeric foam, which may include reinforcing materials, is either injected or poured into the mold and permitted to set, thereby substantially embedding the inserts 602 and 610 in the foam core 664, preferably with a narrow portion of the inserts extending out from the surface of the foam, for example, with the threaded insert 602 extending from the inside surface of the foam and the tubular insert 610 extending slightly from both the inside and outside surface of the foam (where inside surface refers to the side that will be facing the opposite sidewall and outside surface refers to the side that will face away from the opposite sidewall). Fiberglass is then placed into a mold around the foam core 664 and the assembly is pressed together under heat and pressure to form the structural frame member. In the disclosed embodiment both sidewalls 622, 624 of the frame 620 are formed as a single, integral piece with the transverse member 626. In the alternative embodiments discussed above the sidewalls and transverse member may be formed as separate pieces, or in various combination, and then assembled into the desired frame. It will be appreciated that although fiberglass is used in this preferred embodiment, other outer sidewall materials are also possible, including various structural polymers, and preformed or pressed metals such as aluminum sheets.

In another preferred method of construction, the inner and outer layers 662 and 668 respectively, may first be formed and joined to form a hollow frame shell. For example if the frame shell is made from stamped metal, such as aluminum sheet, or reinforced fiberglass, the shell may be formed in two parts that are then joined together. The inserts 302 and 310 may be positioned in the frame shell, and suitable foam core material injected into the shell to form the foam core 664 with the inserts embedded therein.

Figure 12:
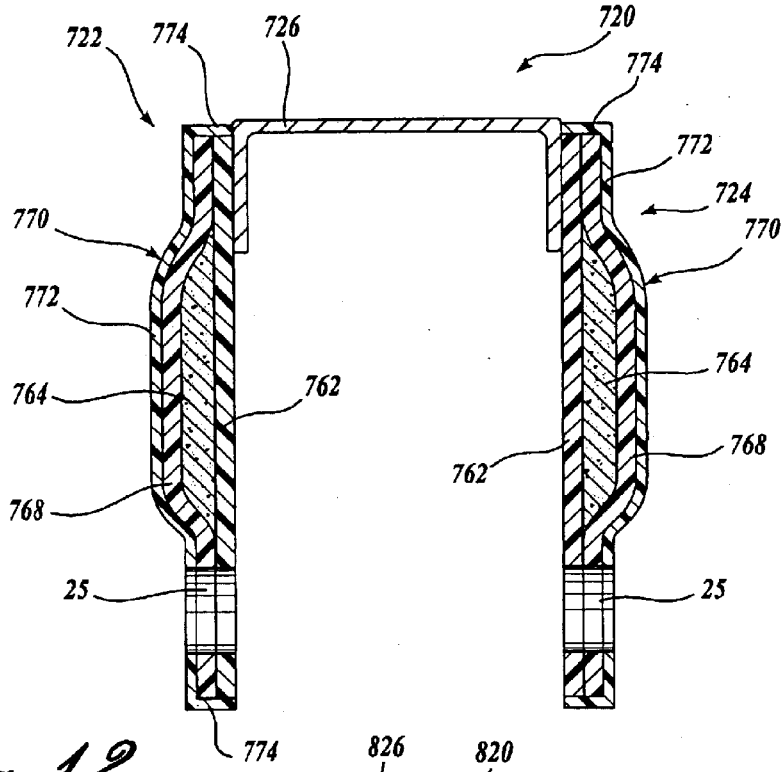
FIG. 12 is a cross-sectional view of another embodiment of a frame constructed in accordance with the present invention, showing a foam core frame having a protective cap disposed on the sidewalls.

FIG. 12 shows another embodiment of a skate frame 720 according to the present invention, wherein a lateral sidewall 722 and a medial sidewall 724 are connected with a transverse member 726 forming a channel therebetween sized to accommodate skate wheels (not shown). The sidewalls 722, 724 may be connected to the transverse member 726 in any conventional manner, for example by bonding, riveting, using threaded fasteners, and the like. The sidewalls 722, 724 each include an inner layer 762 and an outer layer 768, with a core material 764 sandwiched in between, and encapsulated by, the layers 762, 768. Opposed, and axially aligned apertures 25 are provided at the base of the frame 720, which may utilize inserts and/or threaded nut plates (similar to those shown in FIG. 11) to accommodate the wheel axles.

The inner and outer layers, 762 and 768 respectively may be constructed in a manner well known in the art from a lightweight and high strength material, such as a carbon fiber reinforced thermosetting polymer or a fiber reinforced thermoplastic. The core material 764 is preferably an unreinforced or reinforced polymer, such as a structural foam or a syntactic foam, having an average density that is less than the density of the inner and outer layers 762, 768. The core material 764 may alternatively comprise a natural material such as wood, or a low-density viscoelastic material. In the preferred embodiment the core material 764 is encased between the inner layer 762 and the outer layer 768, and extends longitudinally for a substantial portion of the length of the sidewalls 722 and 724. As shown in FIG. 12, the inner and outer layers 762, 768 abut against each other at the edges of the sidewalls 722, 724, and abut together at the axle apertures 25, providing structural support for the axle loads.

In the present embodiment the outer layer 768 of each sidewall 722, 724 is covered with a protective and/or decorative cap 770 that conforms and adheres to the outer layer 768. The protective cap 770 includes a main body portion 772 and a peripheral lip portion 774 extending from the body portion 772. The lip portion 774 extends generally over the edge of the sidewalls 722, 724 to protect and/or improve the aesthetic aspects of the sidewalls 722 and 724.

The protective cap 770 is preferably made from a relatively elastic, abrasion-resistant material, for example a tough polymer such as nylon, urethane, acrylic, polycarbonate or blends thereof that will not splinter or fray when abraded. The preferred cap material is a blend of acrylic and urethane. It will be appreciated from FIG. 12 that the protective cap 770 extends over substantially all of the visible surfaces of the frame 720 providing great control over the aesthetic look of the frame 720, and in particular allows the edges of the frame 720 to be decoratively covered. The protective cap is preferably between about 0.003 inches and 0.025 inches thick, and most preferably about 0.018 inches thick.: The cap material is preferably transparent or at least partially transparent, and will bond to decorative inks or be decorateable by sublimating a dye into the material.

It will also be appreciated that in particular for frames utilizing a fiber-type composite material such as a carbon fiber reinforced composite, the composite material can have a tendency to fray at the edges when subjected to external stressors such as abrasions and the like. By providing a flexible cap over the edges, the fiber composite portion of the frame is protected from such wear and tear, and the durability of the skate frame's appearance is improved. The portion of the frame 720 facing the channel between sidewalls 722, 724 is substantially hidden from view by the skate wheels and the opposite sidewall.

Although the protective cap construction is shown in FIG. 12 applied to a foam core skate frame 720, it will be readily apparent to one of skill in the art that a protective cap could be provided to a conventional, solid frame construction, for example an aluminum frame or a solid carbon fiber reinforced epoxy frame, thereby providing aesthetic and protective advantages to such frame.

In a preferred method of constructing the sidewalls, a first mold piece having an indented portion corresponding to the desired frame sidewall shape is provided. A sheet of protective film, which may be partially pre-formed to correspond to the desired skate shape, is placed into or over the first mold piece indented portion. The protective film may be provided with a decorative design, preferably on the inner surface of the film. A first layer of fiber reinforced resin is then pressed into the mold depression, over the protective film. A pre-shaped core material, such as a polymeric foam is then placed over a portion of the first layer of fiber reinforced resin, and a second layer of fiber reinforced resin is layed up over the core material and the first layer. A second mold piece is then placed over the mold, and the mold is heated and pressed to facilitate setting of the resin. After sufficient time for setting has been allowed, the sidewall is removed from the mold, and excess materials are removed, to produce the desired frame. It will be appreciated that additional mold pieces may be utilized, depending on the complexity of the sidewall shape.

Figure 13:
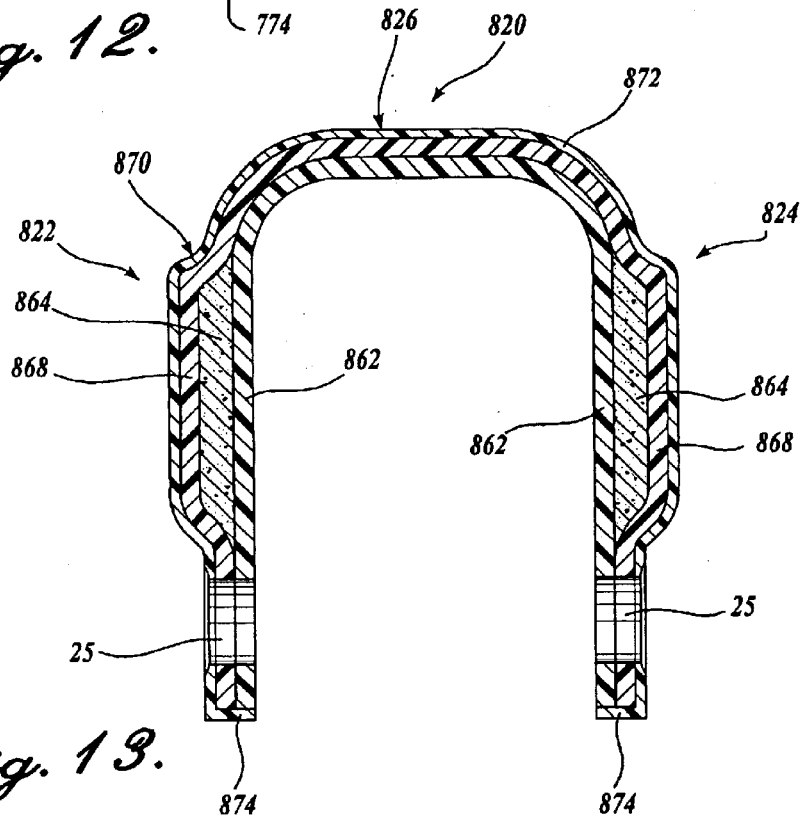
FIG. 13 is a cross-sectional view of another embodiment of a frame constructed in accordance with the present invention, showing a unitary foam core frame having a protective cap disposed over the outer layer of the frame.

Similarly, in a preferred method of constructing a skate frame, wherein the skate frame is made unitarily, such as that shown in FIG. 13, a sheet of protective film, which may be partially pre-formed to correspond to the desired skate shape, is placed into or over a first mold piece indented portion. The protective film may be provided with a decorative design, preferably on the inner surface of the film. A first layer of fiber reinforced resin is then pressed into the mold depression, over the protective film. A pre-shaped core material, such as a polymeric foam is then placed over a portion of the first layer of fiber reinforced resin, and a second layer of fiber reinforced resin is layed up over the core material and the first layer. A second mold piece is then placed over the second layer of fiber reinforced resin and the mold is heated and pressed to facilitate setting of the resin. After sufficient time for setting has been allowed, the skate is removed from the mold, and excess materials are removed, to produce the desired frame. It will be appreciated that additional mold pieces may be utilized, depending on the complexity of the sidewall shape. In particular, separate left and right sidewall outer mold pieces may be utilized, with a third outer mold piece provided for the transverse portion of the skate.

Although a preferred method of construction has been described, it will be apparent that other methods of construction are possible and contemplated by this invention. For example, the layer materials or foam core may be injected into an assembled mold that is adapted to receive an injection of foam or resin material. Alternatively, the cap may be preformed to conform to the outer shape of the sidewalls, placed over the finished sidewalls and affixed thereto, for example with an adhesive. Other methods of construction will be apparent to one of skill in the art.

Yet another embodiment of a skate frame 820 according to the present invention is shown in FIG. 13, wherein a lateral sidewall 822, a medial sidewall 824 and a connecting transverse portion 826 are formed as a unitary member, with a channel therebetween sized to accommodate skate wheels. The skate frame 820 includes an inner layer 862 and an outer layer 868, with core material 864 encapsulated in between the inner and outer layers 862, 868. Opposed, axially aligned apertures 25 are provided at the base of the frame 820, which may utilize inserts and/or threaded nut plates (similar to those shown in FIG. 11) to accommodate the wheel axles.

The frame 820 is covered with a protective and/or decorative cap 870 that conforms and adheres to the outer layer 864, extending over the connecting transverse portion 826. The protective cap 870 includes a main body portion 872 and a peripheral lip portion 874 extending from the body portion 872. The lip portion 874 extends generally over the edge of the frame 820 to protect and/or improve the aesthetic aspects of the sidewalls 822 and 824.

The protective cap 870 is preferably made from a relatively elastic, abrasion-resistant material, for example a tough polymer such as nylon or urethane, that will not splinter or fray when abraded.

Figure 14:
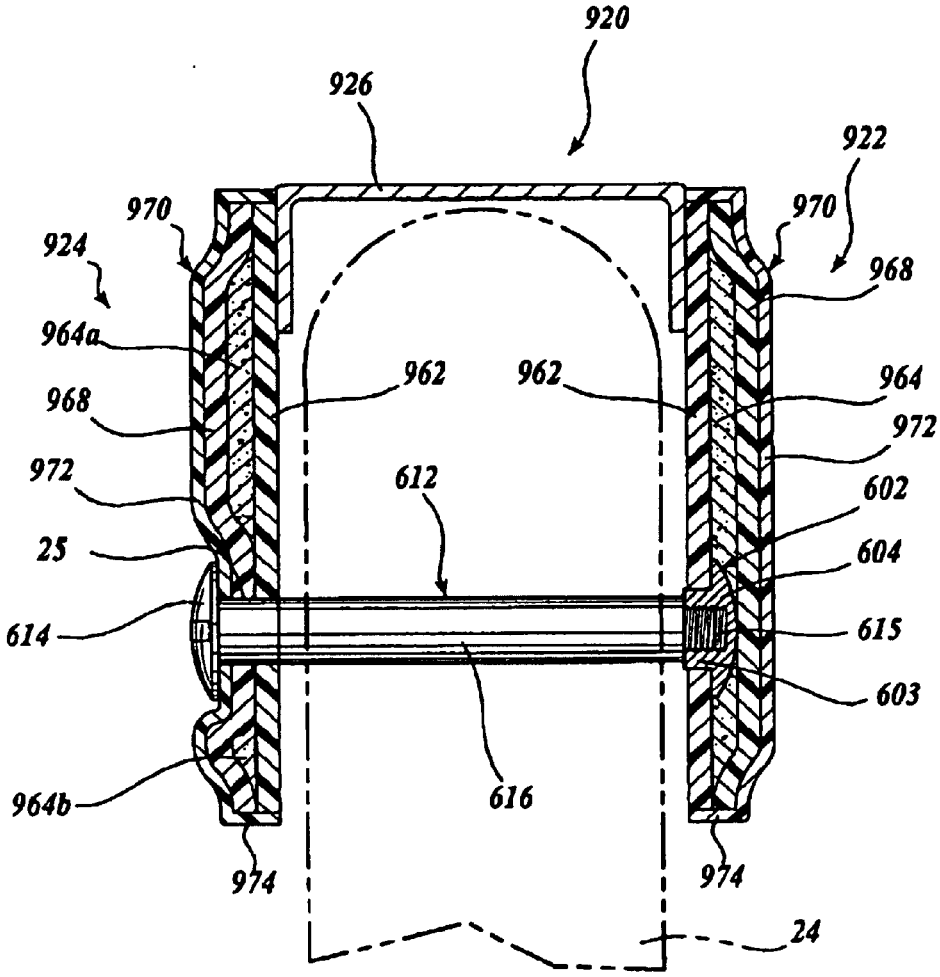
FIG. 14 is a cross-sectional view of another embodiment of a frame constructed in accordance with the present invention, showing a foam core frame having a protective cap disposed on the sidewalls, and an axle mounted utilizing an embedded threaded insert.

Another embodiment of a skate frame 920 according to the present invention is shown in FIG. 14, having an axle assembly similar to that shown in FIG. 11, while also utilizing the cap construction shown in FIG. 12. In particular, a lateral sidewall 922, and a medial sidewall 924 are connected at an upper edge with a transverse member 926, forming a channel therebetween sized to accommodate skate wheels. The sidewalls 922, 924 each include an inner layer 962 and an outer layer 968, with core material 964 encapsulated in between the inner and outer layers 962, 968.

A threaded insert 602 having a head portion 604 embedded in the foam core 964 of the lateral sidewall 922, and a threaded tubular portion 603 extending through the inner layer 962 of the lateral sidewall 922. An axle 612 including a shaft 616 with a head 614 at one end and a threaded portion 615 at the other end is inserted through an aperture in the medial sidewall 924, to threadably engage the threaded insert 602. The outer layers 968 are covered with a protective and/or decorative cap 970 that conforms and adheres to the outer layer 968. The protective cap 970 includes a main body portion 972 and a peripheral lip portion 974 extending from the body portion 972. The lip portion 974 extends generally over the edges to protect and/or improve the aesthetic aspects of the sidewalls 922 and 924.

In this embodiment the foam core of the medial sidewall 924 comprises an upper portion 964*a* and a lower portion 964*b*. The outer layer 968 of the medial sidewall 924 curves inwardly to engage the inner sidewall 962 between the foam core portions 964*a* and 964*b*, providing structural support at the aperture 25 for the axle 612. Another advantage of the protective cap construction is apparent from FIG. 14, wherein the protective cap 970 extends underneath the head 614 of the axle 612, thereby protecting the outer layer 968 from wear and abrasion from the axle head 614. It will also be appreciated that in this construction the axle head 614 is disposed in a recessed portion of the sidewall 924, thereby protecting the axle head 614 from damage from inadvertent bumping and/or scraping during skating.

Although this embodiment is shown with an embedded, threaded insert 604 in the lateral sidewall 922, it will be readily apparent that the lateral sidewall could alternatively be formed with a foam core similar to that shown for the medial sidewall 924, and a conventional axle nut could be utilized to attach the axle 612 to the frame 920.

The previously described versions of the present invention have several advantages over skate frames currently available in the art. The skate frame of the present invention is lighter than solid composite or aluminum frames because a lightweight core material occupies a substantial volume within the frame. Also, because the core material is lightweight and has moderate structural properties in terms of strength and stiffness, the strength-to-weight ratio of the frame is increased. Further, because the skate frame of the present invention utilizes a core material that is less expensive than the reinforced composite material it replaces, it is more cost efficient than skate frames having an all composite construction. Finally, because core material is removed from the load introduction points associated with the wheels and shoe portion, the skate frame has a longer useful life than skate frames having a core that is in direct contact with the load introduction points. Thus, a skate frame constructed in accordance with the present invention has an increased strength-to-weight ratio and is less expensive than those currently available in the art.

From the foregoing description, it may be seen that the skate of the present invention incorporates many novel features and offers significant advantages over the prior art. It will be apparent to those of ordinary skill that the embodiments of the invention illustrated and described herein are exemplary only and, therefore, changes may be made to the foregoing embodiments. As a nonlimiting example, core material located within the sidewalls or upper surface of the skate frame may bulge outwardly, such that the sidewalls have a bubble contour to accommodate the core. Thus, it may be appreciated that various changes can be made to the preferred embodiment of the invention without departing from the spirit and scope of the invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A frame for a skate, the frame comprising:

(a) an elongate structural member comprising first and second oppositely-disposed, spaced-apart sidewalls joined by a transverse structure spanning therebetween, wherein each sidewall has an outwardly facing surface, an inwardly facing surface, and a peripheral edge therebetween, the peripheral edge including a lower portion, the first and second sidewalls and transverse structure cooperatively forming a wheel channel;

(b) a protective cap affixed to the outwardly facing surface of each sidewall, wherein the protective cap wraps around the lower portion of the peripheral edge.

2. The frame of claim 1 wherein the protective cap is made from an abrasion resistant polymer.

3. The frame of claim 2, wherein the first and second sidewalls comprise an inner core material and an outer layer.

4. The frame of claim 3, wherein the outer layer comprises a graphite fiber reinforced composite material.

5. The frame of claim 4, wherein the core material comprises a polymeric foam.

6. The frame of claim 1 wherein the protective cap comprises nylon.

7. A The frame of claim 1, wherein the protective cap comprises urethane.

8. The frame of claim 1, wherein the protective cap wraps around all of the lower portion of the peripheral edge of each sidewall.

9. The frame of claim 1, wherein the protective cap covers substantially all of the outwardly facing surface of each sidewall.

10. An inline skate comprising:

(a) a plurality of wheels, each wheel having an axial aperture therethrough;

(b) a frame comprising first and second spaced-apart sidewalls joined by a transverse structure spanning therebetween and cooperatively forming a channel dimensioned to receive the plurality of wheels, wherein the first and second sidewalls each include a structural portion and a protective cap, the structural portion having an inward surface, an outward surface and a peripheral edge therebetween the peripheral edge including a lower portion, and the protective cap disposed on the outward surface and wrapping around the lower portion of the peripheral edge of the sidewalls;

(c) a plurality of axles adapted to rotatably attaching the plurality of wheels to the frame; and (d) an upper shoe attached to an upper surface of the frame for receiving a skater's foot.

11. The inline skate of claim 10, wherein the cap comprises an abrasion-resistant polymer.

12. The inline skate of claim 11, wherein the abrasion-resistant polymer comprises urethane.

13. The inline skate of claim 11, wherein the structural portion of the first and second sidewalls comprise a polymeric foam core material and a composite outer layer encapsulating the core material.

14. The inline skate of claim 10, wherein the protective cap further comprises a decorative design.

15. An inline skate comprising:

(a) a shoe portion;

(b) a plurality of wheels having an axial aperture therethrough;

(c) an elongate frame attached to the shoe portion, the frame comprising:

(i) first and second sidewalls interconnected with a transverse member, the sidewalls defining a channel that is sized to accommodate the plurality of wheels, wherein the sidewalls each include a foam core portion, an outer layer encapsulating the foam core portion, and a protective cap portion covering at least part of the outer layer;

(ii) a plurality of threaded inserts, each threaded insert having a head and a tubular post, the tubular post having internal threads, wherein the head is embedded in the foam core portion of the first sidewall and the tubular post extends through the outer layer into the channel;

(iii) a plurality of tubular inserts, each tubular insert having a circumferential ridge, the tubular insert axially aligned with one of the plurality of threaded insert and extending through the outer layer and the foam core portion of the second sidewall wherein the tubular insert defines an aperture through the second sidewall and the circumferential ridge is embedded in the foam core portion of the second sidewall; and (d) a plurality of axles having a proximal head portion and a threaded distal portion, wherein the threaded distal portion is slidably insertable into at least one of the plurality of tubular inserts and through at least one of the plurality of wheel axial apertures and engages the aligned threaded insert.

16. The inline skate of claim 15 wherein the frame has a lateral side and a medial side and wherein the first sidewall is disposed on the lateral side of the frame and the second sidewall is disposed on the medial side of the frame.

17. The inline skate of claim 15, wherein the outer layer comprises fiberglass.

18. The inline skate of claim 15, wherein the outer layer comprises a graphite fiber reinforced composite material.

19. The inline skate of claim 15, wherein the proximal head portion of the plurality of threaded inserts are non-axisymmetric.

* * * * *

UNITED STATES PATENT AND TRADEMARK OFFICE

CERTIFICATE OF CORRECTION

PATENT NO. : 6,851,681 B2
DATED : February 8, 2005
INVENTOR(S) : J.E. Svensson et al.

It is certified that error appears in the above-identified patent and that said Letters Patent is hereby corrected as shown below:

Column 15,
Line 29, "7. A The frame" should read -- 7. The frame --

Signed and Sealed this

Twenty-fourth Day of May, 2005

JON W. DUDAS
*Director of the United States Patent and Trademark Office*